US005366407A

United States Patent [19]

Sentoku

[11] Patent Number: 5,366,407

[45] Date of Patent: Nov. 22, 1994

[54] COIN RECEIVING AND DISPENSING MACHINE

[75] Inventor: Hideshi Sentoku, Tokyo, Japan

[73] Assignee: Laurel Bank Machines Co., Ltd., Tokyo, Japan

[21] Appl. No.: 70,357

[22] PCT Filed: Oct. 5, 1992

[86] PCT No.: PCT/JP92/01285

§ 371 Date: Jun. 2, 1993

§ 102(e) Date: Jun. 2, 1993

[87] PCT Pub. No.: WO93/07592

PCT Pub. Date: Apr. 15, 1993

[30] Foreign Application Priority Data

Oct. 3, 1991 [JP] Japan ..... 3-256807

[51] Int. Cl.[5] ..... G07D 3/16

[52] U.S. Cl. ..... 453/3; 453/17; 453/32

[58] Field of Search ..... 453/3, 7, 11, 16, 17, 453/32; 194/27, 218

[56] References Cited

U.S. PATENT DOCUMENTS 4,558,711 12/1985 Yoshiaki et al. ..... 453/3
5,002,516 3/1991 Watanabe et al. ..... 453/7
5,059,153 10/1991 Goi ..... 453/17 X

FOREIGN PATENT DOCUMENTS 60-123991 7/1985 Japan .
61-253595 11/1986 Japan .
2150986 6/1990 Japan .
36794 1/1991 Japan .

*Primary Examiner*—F. J. Bartuska
*Attorney, Agent, or Firm*—Cushman, Darby & Cushman

[57] ABSTRACT

A coin receiving and dispensing machine having a replenishing coin storage box and a first transporting system for replenishing coins in coin storage cylinders by denomination when the coins in at least one of the coin cylinders fall below a first predetermined level, and a coin replenishing box and a second transporting system for supplementing additional coins to the first transporting system when the coins in at least one of the coin cylinders fall below a second lower predetermined level. The two separate coin storage boxes allows for the replenishment of coins while at the same time allowing simultaneous operation of the coin receiving and dispensing function of the machine. The coin receiving and dispensing machine includes a microcomputer, sensors in the transporting systems for determining the acceptability and amount of coins, coin sorting means for sorting coins by denomination into the coin storage cylinders, sensors in each coin storage cylinder for detecting a number of stored coins, a replenishment coin storage box which replenishes coins in the coin storage cylinders, and a coin replenishing box which supplies additional replenishment coins. The coin receiving and dispensing machine further includes information on the number of coins stored in the replenishment coin storage box and notifies the teller of a low coinage supply.

4 Claims, 5 Drawing Sheets

COIN RECEIVING AND DISPENSING MACHINE

TECHNICAL FIELD

The present invention relates to a coin receiving and dispensing machine in which received coins are utilized as coins to be dispensed and, in particular, to a coin receiving and dispensing machine which allows received coins to be utilized as coins to be dispensed, which can be replenished with coins and which can receive and dispense coins during coin replenishment.

BACKGROUND OF THE ART

As disclosed in Laid-Open Japanese Patent Application No. 61-253595, there is known a coin receiving and dispensing machine which sorts received coins in accordance with their denominations, stores the sorted coins and uses the stored coins for dispensation.

The coin receiving and dispensing machine of this type comprises first transporting means for transporting received coins, first discriminating and counting means for discriminating the genuineness of the received coins and counting the number of genuine coins in accordance with their denominations, temporary storing means for temporarily storing coins which have been discriminated genuine and counted, second transporting means for coins temporarily stored in the temporary storing means inside of the coin receiving and dispensing machine, second discriminating and dispensing means for discriminating the denominations of coins being transported by the second transporting means, a plurality of coin storing means for storing coins in accordance with their denominations, sorting means for causing the coin storing means to selectively store coins in accordance with their denominations based upon the result of discrimination made by the second discriminating and counting means, dispensing means for, when a customer requests dispensation of coins, selectively dispensing coins in an amount corresponding to that requested by the customer from the coin storing means, a coin box for accommodating coins having denominations for replenishing coins in coin storing means in which the number of coins has become lower than a first predetermined number and accommodating coins having denominations which cannot be stored in coin storing means because the number of coins stored in the coin storing means has become greater than a second predetermined number greater than the first predetermined number, and distributing means for distributing coins stored in the coin box into the coin storing means whose coins are to be replenished.

The coin box provided in this coin receiving and dispensing machine serves two functions; to accommodate coins which cannot be stored in the coin storing means and to accommodate coins to be used for replenishing coins in the coin storing means.

Accordingly, if the number of coins stored in a coin storing means for storing coins of a certain denomination becomes lower than a first predetermined number and the number of coins of the denomination accommodated in the coin box is low, even if the number of coins stored in other coin storing means is not lower than the first predetermined number, it is necessary to remove the coin box from the coin receiving and dispensing machine and replenish it with coins of the denomination the number of which has become lower than the first predetermined number in the coin storing means.

However, while the coin box is removed from the coin receiving and dispensing machine and coins are being replenished, if coins are deposited into the machine and the number of coins in the coin storing means for storing another denomination of coins becomes greater than a second predetermined number, the coin storing means cannot store any further coins and since the coin box has been removed, the coin box cannot accommodate the coins which cannot be stored in the coin storing means. Therefore, the coin receiving operation cannot be carried out while the coin box is removed from the coin receiving and dispensing machine and the coins are being replenished. Further, even if the number of coins of the denomination stored in the coin storing means was greater than or equal to the first predetermined number when the coin box was removed from the coin receiving and dispensing machine, if a number of coins of a particular denomination has to be dispensed in response to a customer's request for dispensation, since the number of coins of the denomination may become short, the dispensing operation has to be stopped while the coin box is removed from the coin receiving and dispensing machine and coins are being replenished. As a consequence, the coin receiving and dispensing machine cannot be operated during replenishment of the coins in the coin box, so that the operational efficiency becomes low.

Therefore, the object of the present invention is to provide a coin receiving and dispensing machine in which received coins are utilized as coins to be dispensed and coins can be replenished and which can receive and dispense coins during coin replenishment.

DISCLOSURE OF THE INVENTION

The above object of the present invention can be accomplished by a coin receiving and dispensing machine comprising a transaction opening through which coins are deposited and dispensed, first sensor means provided in a coin passage for discriminating whether or not coins deposited through the transaction opening are acceptable and the denominations of coins and counting the number of received coins in accordance with their denominations, coin sorting means for sorting acceptable coins in accordance with their denominations, a plurality of coin storing means for accommodating and storing coins sorted by the coin sorting means in accordance with their denominations, second sensor means provided one for each coin storing means for detecting whether or not the number of coins stored in the associated coin storing means is lower than a first predetermined number, third sensor means provided one for each coin storing means for detecting whether or not the number of coins stored in the associated coin storing means exceeds a second predetermined number greater than the first predetermined number, replenishment coin storing means for storing coins for replenishing the coins stored in a coin storing means when the associated second sensor means detects that the number of coins stored in the coin storing means has become lower than the predetermined number and storing coins to be stored in a coin storing means when the associated third sensor means detects that the number of coins stored in the coin storing means has exceeded the second predetermined number, and transporting means for transporting coins, said coin receiving and dispensing machine further comprising discrimination means for storing information on the number of coins stored in the replenishment coin storing means in accordance with their denominations, discriminating whether or not the number of coins of each denomination stored in the replenishment coin storing means has become lower than a third predetermined number and outputting a judgment signal when the number of coins of one of the denominations has become lower than the third predetermined number, notification means for, when the number of coins of one of the denominations has become lower than the third predetermined number and the discrimination means outputs a judgment signal, receiving a notification signal to such effect, coin replenishing means removable from the machine adapted for storing coins for replenishing the coins in the coin storing means and the replenishment coin storing means when the notification signal is output to the notification means, and fourth sensor means for discriminating the denominations of coins fed out from the coin replenishing means and the replenishment coin storing means and counting the number of coins in accordance with their denominations, the transporting means being adapted for transporting coins fed out from the replenishment coin storing means and the coin replenishing means to the coin sorting means and the coin sorting means being adapted for sorting coins fed out from the replenishment coin storing means and the coin replenishing means and replenishing coins in the coin storing means in accordance with their denominations.

In a preferred aspect of the present invention, the coin receiving and dispensing machine further includes temporary storing means adjacent to the transaction opening adapted for temporarily storing coins, a first rotatable disk for receiving coins from the temporary storing means and feeding coins one by one to the coin passage by a centrifugal force produced by rotation, a second rotatable disk provided for the replenishment coin storing means and a third rotatable disk provided for the coin replenishing means, the transporting means comprising first transporting means which is connected to the second rotatable disk at one end and is connected to a fourth rotatable disk at the other end and second transporting means which is connected to the third rotatable disk and is arranged so as to be able to deliver coins to the first transporting means, a coin sorting passage connected to the fourth rotatable disk for feeding coins to the coin storing means and the temporary storing means, the third rotatable disk being adapted for feeding out coins stored in the coin replenishing means to the second transporting means by centrifugal force produced by rotation, the second rotatable disk being adapted for feeding out coins stored in the replenishment coin storing means to the first transporting means by centrifugal force produced by rotation, and the fourth rotatable disk being adapted for feeding out coins one by one to the coin sorting means by centrifugal force produced by rotation.

In a further preferred aspect of the present invention, first sorting means is provided on the coin passage for sorting acceptable coins, the first sorting means having at the bottom thereof a shutter which can be opened and closed and being connected to a temporary storing box for temporarily storing acceptable coins, and gate means is provided between the first sorting means and the temporary storing box for guiding acceptable coins into the temporary storing box and, when one of the third sensor means detects that the number of coins stored in the associated coin storing means has exceeded the second predetermined number, guiding coins fed out from the temporary storing box and to be stored in the associated coin storing means to the replenishment coin storing means.

According to the present invention, since there are provided the replenishment coin storing means for storing coins for replenishing the coins in the coin storing means when the second sensor means associated therewith detects that the number of coins stored therein has become lower than the first predetermined number and storing coins of denominations for replenishing the coins in the coin storing means when the third sensor means associated therewith detects that the number of coins stored therein has exceeded the second predetermined number, and the removable coin replenishing means which can be replenished with coins by the teller when coins from the replenishment coin storing means have been used to replenish coins in one or more coin storing means so that the number of coins of any denomination stored in the replenishment coin storing means has become lower than the third predetermined number and the notification signal is input to the notification means, thereby notifying the teller of such fact, if the number of coins stored in one of the coin storing means has become lower than the first predetermined number during the coin dispensing operation, coins stored in the replenishment coin storing means are supplied thereto and, as a result, if the number of coins of any denomination stored in the replenishment coin storing means has become lower than the third predetermined number, the notification signal is output to the notification means, whereby the teller can know that the number of coins of any denomination stored in the replenishment coin storing means has become lower than the third predetermined number and respond by removing the removable coin replenishing means from the coin receiving and dispensing machine and replenish coins therein. Therefore, if the third predetermined number is determined so that even if the coin storing means is replenished with coins of the denomination from the replenishment coin storing means between the time that the teller learned that the number of coins of any denomination stored in the replenishment coin storing means became lower than the third predetermined number and the time that the teller removed the coin replenishing means from the coin receiving and dispensing machine to replenish coins therein and remounted it on the coin receiving and dispensing machine, there is no risk of the coins of the denomination running short in the replenishment coin storing means so that it is possible to replenish the coins in the coin receiving and dispensing machine during the coin dispensing operation without stopping the coin dispensing operation.

Further, when, as a result of receiving coins while the coin replenishing means is removed from the coin receiving and dispensing machine, the number of coins stored in one of the coin storing means has come to exceed the second predetermined number and no more coins can be accommodated in the coin storing means, it is possible to accommodate coins to be stored in the coin storing means in the replenishment coin storing means.

Therefore, it is possible to replenish the coins in the coin receiving and dispensing machine without stopping the coin receiving operation and the coin dispensing operation and to markedly improve the operation efficiency of the coin receiving and dispensing machine.

BEST MODE OF THE INVENTION

Hereinafter, an embodiment of the present invention will be described with reference to the accompanying drawings.

Figure 1:
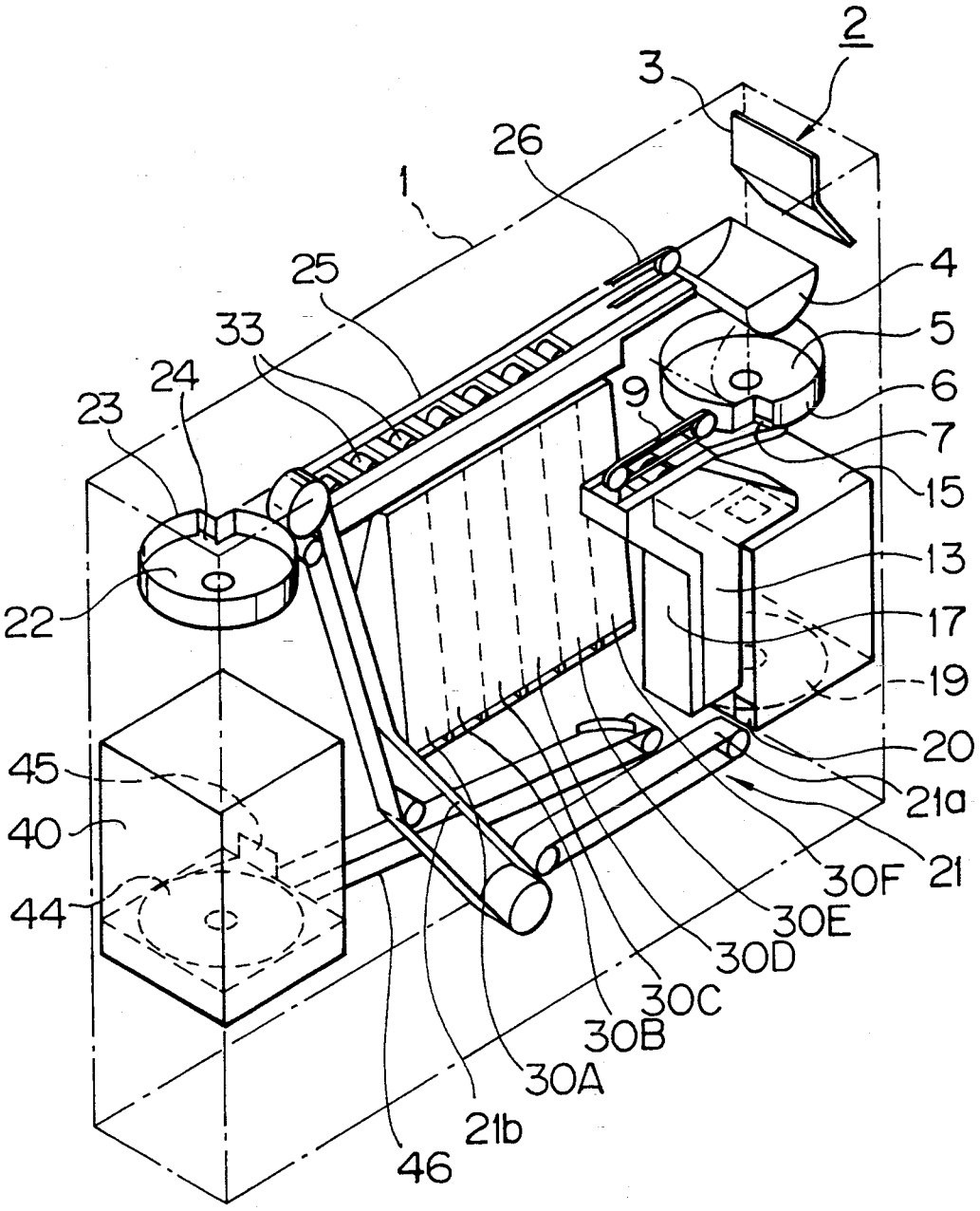
FIG. 1 is a schematic perspective view showing the internal structure of a coin receiving and dispensing machine which is an embodiment of the present invention.
Figure 2:
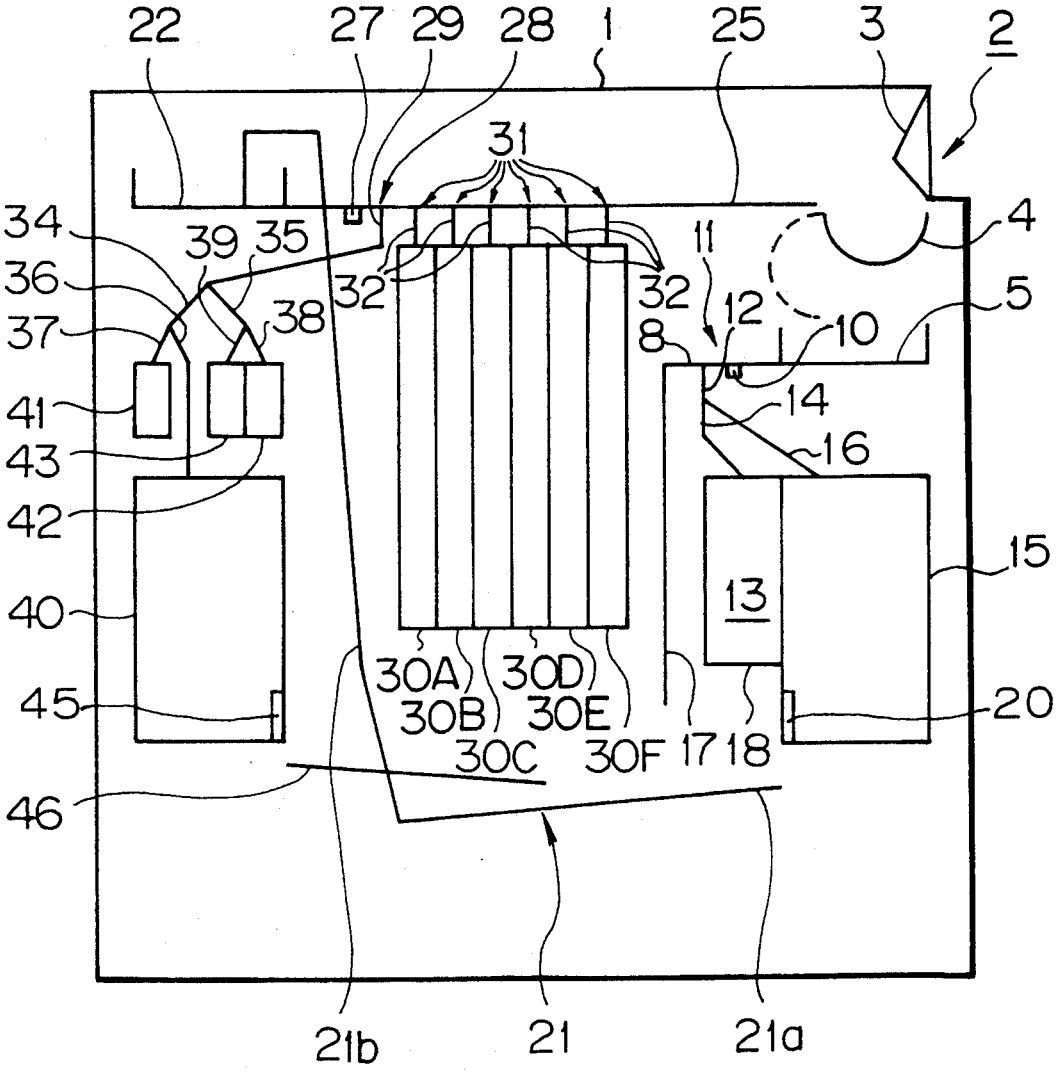
FIG. 2 is a schematic side view showing the internal structure of a coin receiving and dispensing machine which is an embodiment of the present invention.

FIG. 1 is a schematic perspective view showing the internal structure of a coin receiving and dispensing machine which is an embodiment of the present invention and FIG. 2 is a schematic longitudinal view thereof. The coin receiving and dispensing machine according to this embodiment is controlled by a microcomputer in the following manner. Received coins are selectively accommodated and stored in coin storing cylinders in accordance with their denominations and excessive coins which cannot be accommodated in the coin storing cylinder(s) because the number of coins stored in the coin storing cylinder(s) exceeds a second predetermined number are accommodated and stored in a replenishment coin storing box. When the number of coins stored in the coin storing cylinder(s) has become lower than a first predetermined number lower than the second predetermined number as the result of dispensation, coins stored in the replenishment coin storing box are supplied to the coin storing cylinder(s). When one of the denominations of coins stored in the replenishment coin storing box has become lower than a third predetermined number, a notification means announces such fact. When the number of coins stored in one of the coin storing cylinders has become lower than the first predetermined number and the number of coins stored in the replenishment coin storing box of the same denomination as those stored in the coin storing cylinder has become lower than the third predetermined number, coins are supplied to the coin storing cylinder from a removable coin replenishing box which has been filled with coins in advance by the teller.

Referring to FIGS. 1 and 2, a coin receiving and dispensing machine 1 has a transaction opening 2 at an end wall thereof for receiving coins into the coin receiving and dispensing machine 1 or dispensing coins from the coin receiving and dispensing machine 1 and a cover 3 is mounted on the transaction opening 2 to make it openable and closable. A temporary storing portion 4 is disposed adjacent to the transaction opening 2 in the coin receiving and dispensing machine 1 for storing coins to be received or coins to be dispensed. The temporary storing portion 4 is rotatable in the vertical plane by an appropriate means (not shown) such as a drive shaft connected to the motor shaft of a drive motor (not shown), thereby enabling coins to be dropped.

Figure 3:
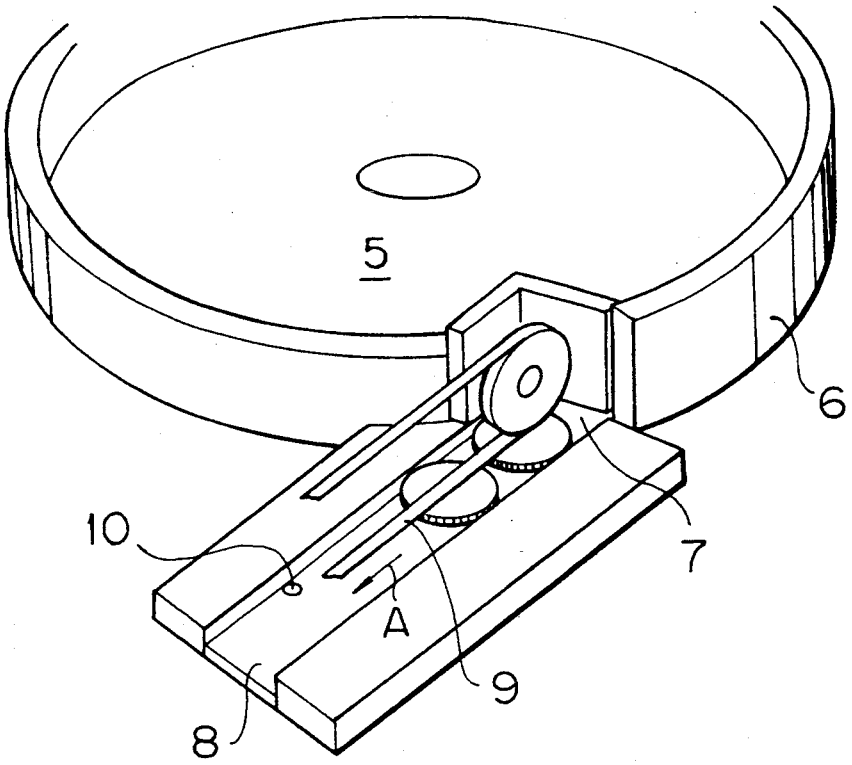
FIG. 3 is a schematic drawing showing a partial enlarged view of a rotatable disk and a coin passage.

Below, the temporary storing portion 4, a rotatable disk 5 is disposed so that the upper surface thereof can receive coins dropped from the temporary storing portion 4. As shown in FIG. 3, a ring-like guide 6 is fixed at the immediate outside of the circumference of the rotatable disk 5 and the ring-like guide 6 is formed with a slot 7 the gap of which is larger than the thickness of the thickest coins and smaller than double the thickness of the thinnest coins among the coins to be handled. Coins dropped from the temporary storing portion 4 onto the rotatable disk 5 are pressed against the inner surface of the guide 6 by centrifugal force produced by the rotation of the rotatable disk 5 and are fed out along the inner surface of the guide 6 through the slot 7 one by one.

A coin passage 8 is connected to the slot 7. The coin passage 8 is provided with a transporting belt 9 adapted for pressing coins against the upper surface of the coin passage 8 and moving them in the direction indicated by the arrow A. Further, there is provided in the coin passage 8 a sensor 10 for discriminating, based upon the diameter and the magnetic properties of the coins, whether or not the coins are counterfeit coins, foreign coins or damaged coins the damage level of which exceeds a predetermined level, namely, whether or not the coins are acceptable, and counting the number of received coins in accordance with their denominations. The result of the discrimination and counting by the sensor 10 is input to a microcomputer (not shown).

Figure 4:
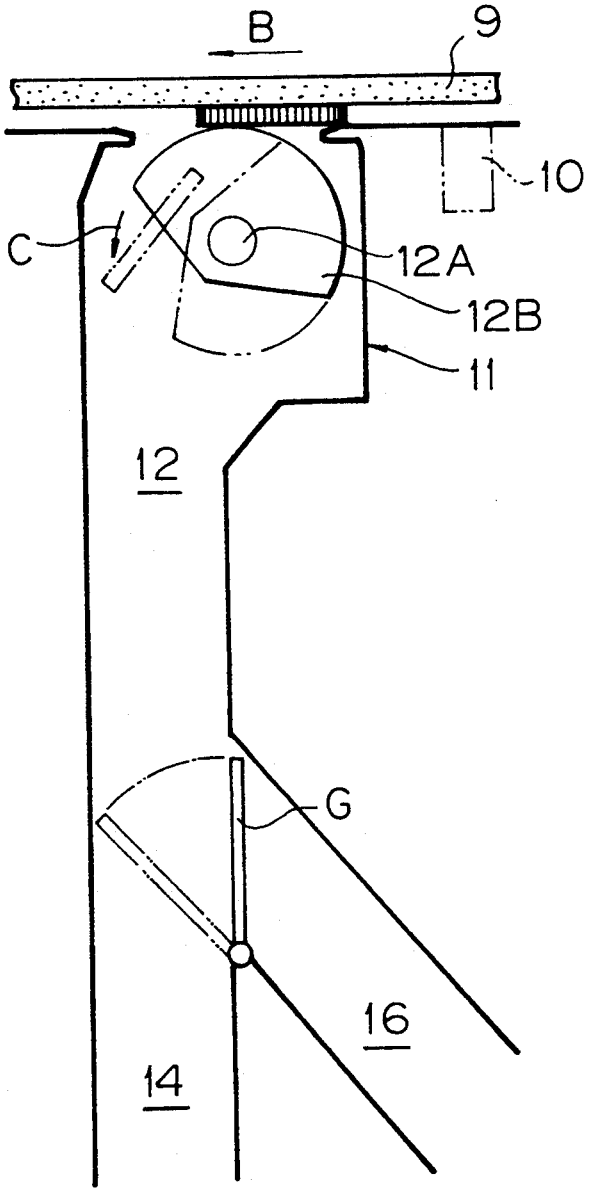
FIG. 4 is a schematic cross-sectional view showing a sorting device.

As shown in FIG. 4, a sorting device 11, provided adjacent to the sensor 10 in the coin passage 8, is driven by the microcomputer in accordance with the result of the discrimination made by the sensor 10 and is adapted for sorting acceptable coins from unacceptable coins. The sorting device is connected to the lower surface of the coin passage 8 so as to be substantially perpendicular thereto and comprises a sorting passage 12 through which coins can be dropped and a sorting roller 12B which is rotatably supported by a shaft 12A and is formed by a cylinder a part of which is cut off. The sorting roller 12B is held in the position indicated by a solid line in FIG. 4 when it does not drop coins into the sorting passage 12 and allows them to pass through as indicated by the arrow B, and is rotated from the position indicated by the solid line to the position indicated by the broken line when it causes coins to be dropped into the sorting passage 12 as indicated by the arrow C.

The sorting passage 12 bifurcates into a first passage 14 communicating with a temporary storing box 13 for temporarily storing coins and a second passage 16 communicating with a replenishment coin storing box 15 for accommodating coins which cannot be accommodated in storing cylinder(s) described later and supplying coins into the storing cylinder(s) as occasion demands. A gate member G is provided so as to be swingable at the portion bifurcating into the first passage 14 and the second passage 16 for guiding coins to either the temporary storing box 13 or the replenishment coin storing box 15. At an end of the coin passage 8 downstream of the sorting device 11, a coin drop passage 17 is connected for dropping counterfeit coins, foreign coins or damaged coins the damage level of which exceeds a predetermined level, namely, unacceptable coins, and returning them to the customer.

At the bottom portion of the temporary storing box 13 is provided a shutter 18 which can be opened and closed.

A rotatable disk 19 is disposed at the lower portion of the replenishment coin storing box 15 for feeding out stored coins and a wall portion of the replenishment coin storing box 15 adjacent to the rotatable disk 19 is formed with a gate 20 which can be opened and closed so that a relatively large amount of stored coins can be simultaneously fed out. A transporting belt mechanism 21 is disposed adjacent to the gate 20. The transporting belt mechanism 21 includes a portion 21*a* extending in substantially the horizontal direction and a portion 21*b* which is connected to the portion 21*a* so that coins can be delivered and extends upwardly in the direction perpendicular to the portion 21*a*. The upwardly extending portion 21*b* has crosspieces (not shown) for holding the coins as they are lifted up to a rotatable disk 22 disposed at the upper portion of the coin receiving and dispensing machine 1.

Similarly to the rotatable disk 5, a ring-like guide 23 is fixed at the immediate outside of the circumference of the rotatable disk 22 and the ring-like guide 23 is formed with a slot 24 the gap of which is larger than the thickness of the thickest coins and smaller than double the thickness of the thinnest coins among the coins to be handled. A coin passage 25 connected to this slot 24 extends from the slot 24 to the temporary storing portion 4 and has a transporting belt 26 similar to the transporting belt 9.

The coin passage 25 is provided in the vicinity of the rotatable disk 22 with a sensor 27 for discriminating, based upon the diameter and the magnetic properties of the coins, whether or not the coins are counterfeit coins, foreign coins, damaged coins the damage level of which exceeds a predetermined level, and the denominations, and counting the number of received coins in accordance with their denominations. The result of the discrimination and counting by the sensor 27 is input to a microcomputer (not shown). A sorting device 28 is provided in the coin passage 25 immediately downstream of the sensor 27 so as to be driven by signals from the microcomputer in accordance with the result of the discrimination made by the sensor 27. The sorting device 28 is constituted similarly to the sorting device 11 and includes a sorting passage 29 extending downwardly and a sorting roller (not shown).

A plurality of coin storing cylinders 30A, 30B, 30C, 30D, 30E and 30F are disposed in the coin passage 25 downstream of the sorting device 28 for storing coins in accordance with their denominations and a sorting device 31 is provided at the upper portion of each of the coin storing cylinders 30A, 30B, 30C, 30D, 30E, 30F. Similarly to the sorting device 11 and the sorting device 28, each sorting device 31 includes a sorting passage 32 and a sorting roller 33. The sorting rollers 33 of the sorting devices 31 are selectively rotated by signals output from the microcomputer in accordance with the result of the discrimination made by the sensor 27 thereby accommodating coins of the denominations to be accommodated in the associated coin storing cylinders 30A, 30B, 30C, 30D, 30E and 30F in the associated coin storing cylinders 30A, 30B, 30C, 30D, 30E and 30F. A sensor (not shown) is provided in the coin passage 25 immediately upstream of each sorting device 31 of the coin storing cylinders 30A, 30B, 30C, 30D, 30E and 30F for detecting the coins to be accommodated in the associated coin storing cylinders 30A, 30B, 30C, 30D, 30E and 30F.

Further, each of the coin storing cylinders 30A, 30B, 30C, 30D, 30E and 30F is provided with a first photosensor (not shown) for detecting whether or not the number of stored coins is lower than a first predetermined number and a second photosensor (not shown) for detecting whether or not the number of stored coins exceeds a second predetermined number. Each of the first photosensors and the second photosensors has a light emitter (not shown) and a light receiver (not shown). More specifically, each of the first photosensors output a coin shortage signal to the microcomputer (not shown) when light emitted from its light emitter is received by its light receiver and each of the second photosensors outputs a coin excess signal to the microcomputer (not shown) when light emitted from its light emitter is not received by its light receiver.

When the microcomputer receives a coin excess signal from one of the second photosensors of the coin storing cylinders 30A, 30B, 30C, 30D, 30E and 30F, it prevents the sorting roller 33 of the corresponding coin storing cylinders 30A, 30B, 30C, 30D, 30E or 30F from being rotated and causes coins of the denomination concerned to pass through the associated sorting device 31, thereby ensuring that no coin is accommodated in the corresponding coin storing cylinder 30A, 30B, 30C, 30D, 30E or 30F. A coin feeding out mechanism (not shown) is provided at the lower portion of each of the coin storing cylinders 30A, 30B, 30C, 30D, 30E and 30F for feeding out stored coins one by one to the transporting belt 21 when dispensing coins.

As shown in FIG. 2, the downwardly extending sorting passage 29 bifurcates into a bifurcating passages 34, 35 and each of the bifurcating passages 34, 35 further bifurcates two bifurcating passages 36, 37 and 38, 39. At each bifurcating portion, a gate member (not shown) similar to the gate member G is provided. The bifurcating passages 36, 37, 38, 39 respectively communicate with a coin replenishing box 40 which is removable from the coin receiving and dispensing machine and is filled in advance by a teller with coins for use in replenishing the coins in the coin storing cylinders 30A, 30B, 30C, 30D, 30E and 30F in which the number of stored coins has become lower than the first predetermined number, an uncollected coin storing box 41 for collecting dispensed coins which the customer failed to collect, an unacceptable coin collecting box 42 for collecting counterfeit coins, foreign coins and damaged coins, namely, unacceptable coins, which were erroneously placed in the coin replenishing box 40 by the teller, fed out for replenishment and detected by the sensor 27 and a coin collecting box 43 for, when denominations of coins not to be accommodated were erroneously accommodated in the coin storing cylinder 30A, 30B, 30C, 30D, 30E or 30F and dispensed, collecting the coins. Therefore, the sorting device 28 is driven by a drive signal output from the microcomputer only when unacceptable coins are detected by the sensor 27, when it is detected that the denominations of the coins fed out from the coin storing cylinders 30A, 30B, 30C, 30D, 30E and 30F are not of the prescribed denomination and when it is detected that the customer failed to collect dispensed coins. FIG. 1 has been simplified by omission of the bifurcating passages 34, 35, 36, 37, 38 and 39. The coin replenishing box 40 is constituted so that coins in the coin receiving and dispensing machine can be collected via the sorting passage 29 and the bifurcating passages 34, 36 when the operation is finished.

The coin replenishing box 40 has a rotatable disk 44 for feeding out coins at the lower portion thereof and a gate 45 which can be opened and closed for simultaneously feeding out a relatively large amount of coins. A transporting belt 46 is connected to the downstream side of the gate 45 and is adapted for feeding coins fed out from the coin replenishing box 40 to the transporting belt 21.

Figure 5:
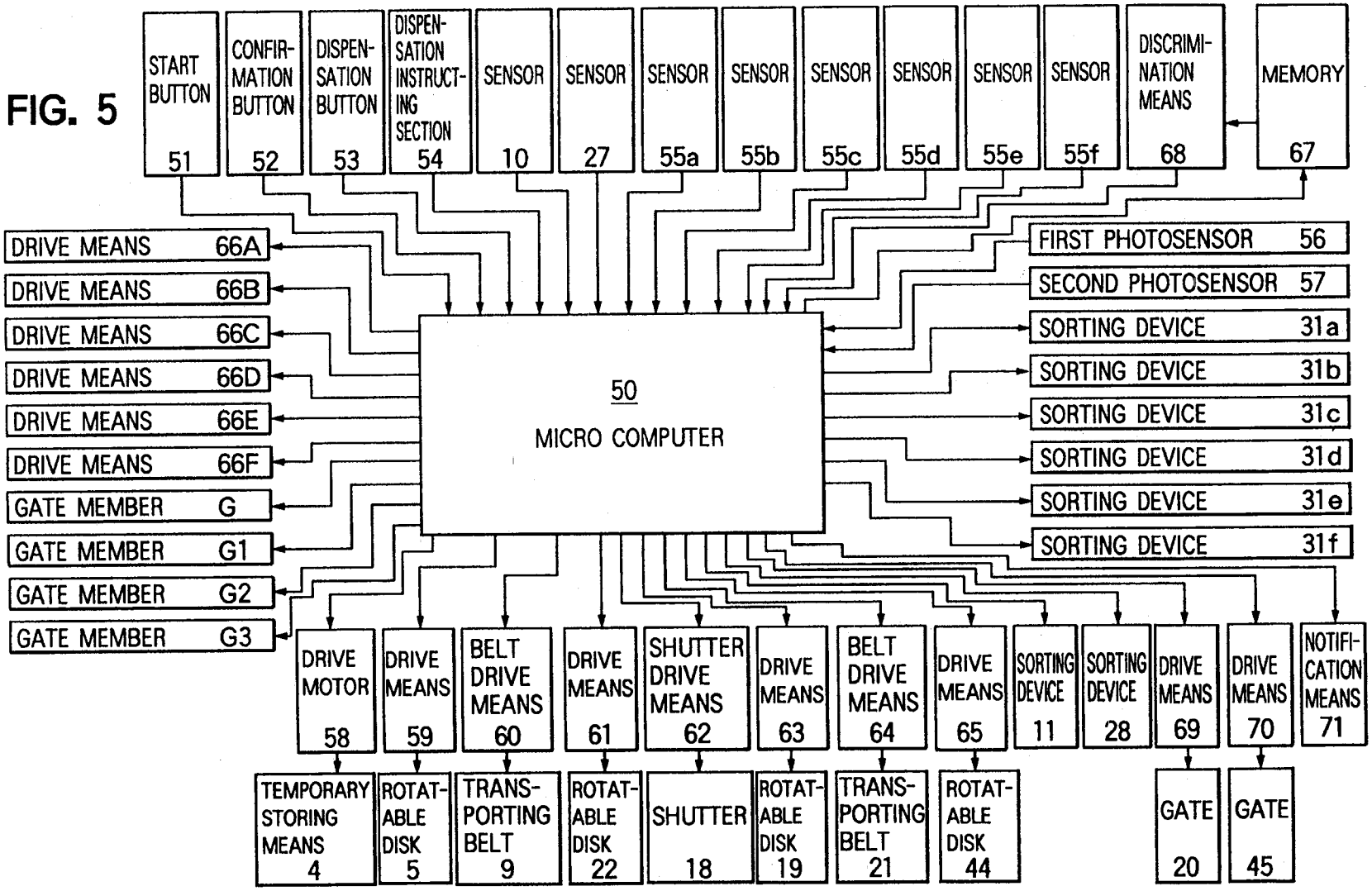
FIG. 5 is a block diagram showing the control system of a coin receiving and dispensing machine which is an embodiment of the present invention.

FIG. 5 is a block diagram showing a control system of a coin receiving and dispensing machine which is an embodiment of the present invention.

In FIG. 5, the control system of a coin receiving and dispensing machine which is an embodiment of the present invention includes a microcomputer 50. The microcomputer 50 receives a start signal from a start button 51 operated by the customer after depositing coins, a confirmation signal from a confirmation button 52 operated by the customer after confirming the amount of the deposited coins, a dispensation instructing signal from a dispensation button 53 operated by the customer for dispensation, a dispensing amount signal from a dispensation instructing section 54 to which the amount of coins to be dispensed is input, discriminating signals and counting signals from the sensor 10 provided in the coin passage 8 and the sensor 27 provided in the coin passage 25, coin detection signals from sensors 55*a*, 55*b*, 55*c*, 55*d*, 55*e* and 55*f* provided in the coin passage 25 for detecting coins, coin shortage signals from the first photosensor 56, coin excess signals from the second photosensor 57, and a judgment signal from a discrimination means 68 for discriminating what denomination of coins is short in the replenishment coin storing box 15 in accordance with information stored in a memory 67 for storing the number of coins of each denomination stored in the replenishment coin storing box 15 based upon signals from the sensor 10, the sensor 27 and the second photosensor 57.

Based upon these signals, the microcomputer 50 selectively outputs drive signals to a drive motor 58 for rotating the drive shaft of the temporary storing portion 4, a drive means, 59 for rotating the rotatable disk 5, a belt drive means 60 for driving the transporting belt 9, the sorting device 11, the sorting device 28 and the sorting devices 31*a*, 31*b*, 31*c*, 31*d*, 31*e*, 31*f* provided for associated coin storing cylinders 30A, 30B, 30C, 30D, 30E, 30F, a drive means 61 for rotating the rotatable disk 22, a shutter drive means 62 for driving the shutter 18, provided at the bottom portion of the temporary storing box 13, the gate member G provided at the bifurcating portion of the first passage 14 and the second passage 16, a gate member G1 provided at the bifurcating portion of the bifurcating passage 34 and the bifurcating passage 35, a gate member G2 provided at the bifurcating portion of the bifurcating passage 36 and the bifurcating passage 37 and a gate member G3 provided at the bifurcating portion of the bifurcating passage 38 and the bifurcating passage 39, a drive means 63 for rotating the rotatable disk 19 provided in the replenishment coin storing box 15, a belt drive means 64 for driving the transporting belt 21, a drive means 65 for rotating the rotatable disk 44 provided in the coin replenishing box 40, feed-out mechanism drive means 66A, 66B, 66C, 66D, 66E, 66F provided at the lower portions of the coin storing cylinders 30A, 30B, 30C, 30D, 30E, 30F, a drive means 69 for opening and closing the gate 20 of the replenishment coin storing box 15, a drive means 70 for opening and closing the gate 45 of the coin replenishing box 40 and a notification means 71 for announcing the fact that coins have to be replenished, and also for storing in the memory 67 the number of coins of each denomination stored in the replenishment coin storing box 15.

The thus constituted coin receiving and dispensing machine 1 operates as follows.

When starting the operation, a sufficient amount of coins are placed in the coin replenishing box 40 for replenishing the coins in the coin receiving and dispensing machine 1. When the teller operates an operation start button (not shown), the microcomputer 50 outputs drive signals to the drive means 65 for rotating the rotatable disk 44, the drive means 70 for opening and closing the gate 45, the belt drive means 64 and the drive means 61 for rotating the rotatable disk 22. As a result, the rotatable disk 44 starts to rotate and the gate 45 is opened, whereby coins stored in the coin replenishing box 40 are fed onto the transporting belt 21 and further fed onto the rotatable disk 22 via the portion 21*a* extending in substantially the horizontal direction and the portion 21*b* extending upwardly. Coins fed onto the rotatable disk 22 are fed to the coin passage 25 through the slot 24. Then, the sensor 27 discriminates whether or not each coin is a counterfeit coin, foreign coin or damaged coin, namely, whether or not it is acceptable, and also counts the number of coins of each denomination. The discriminating signals and the counting signals are output to the microcomputer 50. When the microcomputer 50 judges based upon the discriminating signals input from the sensor 27 that the sensor 27 has detected an unacceptable coin, it outputs drive signals to the sorting device 28, the gate member G1 and the gate member G3, thereby collecting the detected unacceptable coin in the unacceptable coin collecting box 42. On the contrary, acceptable coins are further fed downstream in the coin passage 25 and when the microcomputer 50 receives coin detection signals from each of the sensors 55*a*, 55*b*, 55*c*, 55*d*, 55*e*, 55*f* associated with the coin storing cylinder 30A, 30B, 30C, 30D, 30E, 30F, it outputs a drive signal to the corresponding sorting device 31*a*, 31*b*, 31*c*, 31*d*, 31*e* or 31*f*, thereby storing the coin in the coin storing cylinder 30A, 30B, 30C, 30D, 30E, 30F in which the corresponding denomination of coins are to be stored. In this manner, coins are stored in the coin storing cylinder 30A, 30B, 30C, 30D, 30E, 30F and when the microcomputer 50 receives a coin excess signal from one of the second photosensors 57 of the coin storing cylinder 30A, 30B, 30C, 30D, 30E, 30F, it stops outputting a drive signal to the sorting device 31*a*, 31*b*, 31*c*, 31*d*, 31*e* or 31*f* associated with the coin storing cylinder 30A, 30B, 30C, 30D, 30E or 30F and coins to be stored in the coin storing cylinder 30A, 30B, 30C, 30D, 30E or 30F are fed to the coin passage 8 via the temporary storing portion 4 and the rotatable disk 5. Further, the sensor 10 discriminates whether or not the coins are acceptable and the denomination of the coins and counts the number of the coins, whereafter coins are fed to the sorting device 11. Since coins fed to the sorting device 11 have been discriminated to be acceptable by the sensor 27, the microcomputer 50 outputs a drive signal to the sorting device 11 in accordance with the discriminating signal from the sensor 10, whereby the coins are dropped in the sorting passage 12. In this state, the gate member G is located at a position where the sorting passage 12 and the second passage 16 communicate with each other and, therefore, coins are accommodated in the replenishment coin storing box 15. Every time the microcomputer 50 receives the discriminating signal and the counting signal from the sensor 10, it calculates the number of coins of each denomination stored in the replenishment coin storing box 15 based upon these signals, the discriminating signal and the count signal from the sensor 27 and stores the result in the memory 67.

In the above described manner, when the number of coins stored in all of the coin storing cylinders 30A, 30B, 30C, 30D, 30E and 30F has become equal to the second predetermined number and a predetermined number of coins have been accommodated, the microcomputer 50 terminates the coin supplying operation.

In the case where coins are deposited through the transaction opening 2, they are temporarily stored in the temporary storing portion 4. When a customer operates the start button 51, the microcomputer 50 outputs a drive signal to the drive motor 58 to rotate the temporary storing portion 4, thereby dropping the coins onto the rotatable disk 5. Then, the microcomputer 50 actuates the drive means 59 to rotate the rotatable disk 5 so that the coins are moved along the inner surface of the ring-like guide 6 by centrifugal force produced by the rotation of the rotatable disk 5 and fed out one by one to the coin passage 8 through the slot 7. The coins fed to the coin passage 8 are further fed to the sensor 10 by the transporting belt 9 being driven by the belt driving means 60. The sensor 10 discriminates whether or not the coins are counterfeit coins, foreign coins or damaged coins, namely, whether or not coins are acceptable, and the denomination of the coins, and counts the number of coins in accordance with their denominations.

When the sensor 10 discriminates an acceptable coin, the microcomputer 50 outputs a drive signal to the sorting device 11, thereby rotating the sorting roller 12B. Since the gate member G is positioned so that the sorting passage 12 communicates with the first passage 14, coins are accommodated into the temporary storing box 13 via the sorting passage 12 and the first passage 14.

On the contrary, when the sensor detects that a coin is a counterfeit coin, a foreign coin or a damaged coin the damage level of which exceeds a predetermined level, namely, an unacceptable coin, the microcomputer 50 does not output a drive signal to the sorting device 11, thereby preventing the coin from being dropped in the sorting passage 12 and dropping the coin in the coin dropping passage 17 to feed it onto the transporting belt 21.

When a customer operates the start button 51 and a start signal is input to the microcomputer 50, since the transporting belt 21 is driven by the belt drive means 64 and the rotatable disk 22 is driven by the drive means the unacceptable coins fed onto the transporting belt 21 in the above described manner are fed onto the rotatable disk 22 by the portion **21*a* extending in substantially the horizontal direction and the portion 21*b* extending upwardly and are further fed from the rotatable disk 22 to the coin passage 25 via the slot 24. When any unacceptable coin is detected by the sensor 10, the microcomputer 50 does not output drive signals to the sorting device 28, the sorting devices 31*a*, 31*b*, 31*c*, 31*d*, 31*e*, 31*f* and the like until acceptable coins have been accommodated in the temporary storing box 13 and the unacceptable coins have been returned from the coin dropping passage 17 to the temporary storing portion 4 via the transporting belt 21, the rotatable disk 22 and the coin passage 25. When all of the unacceptable coins have been returned into the temporary storing portion 4, the microcomputer 50 displays the amount of the received coins on a received coin amount display (not shown) in accordance with the result of the count made by the sensor 10. When the confirmation button 52 is operated after the customer has received the unacceptable coins, a confirmation signal is input to the microcomputer 50 and the microcomputer 50 outputs a drive signal to the shutter drive means 62**.

As a result, coins stored in the temporary storing box 13 are fed onto the transporting belt 21 and are further fed to the sensor 27 provided in the coin passage 25 via the rotatable disk 22. After the sensor 27 has discriminated whether or not the coins are genuine, foreign coins or damaged coins the damage level of which exceeds the predetermined level and the denomination of the coins and has counted the coins of each denomination, the coins are fed to the sorting device 28 provided downstream of the sensor 27. Since at the time of receiving coins, all coins temporarily stored in the temporary storing box 13 are acceptable, no drive signal is output to the sorting device 28. Therefore, coins pass over the sorting device 28 and are further fed downstream in the coin passage 25. The microcomputer 50 selectively outputs drive signals to the sorting devices **31*a*, 31*b*, 31*c*, 31*d*, 31*e*, 31*f* in accordance with the result of the discrimination made by the sensor 27 and the coin detection signals output from the sensors 55*a*, 55*b*, 55*c*, 55*d*, 55*e*, 55*f* and causes the coin storing cylinders 30A, 30B, 30C, 30D, 30E, 30F** to store received coins in accordance with their denominations.

On the other hand, when a coin excess signal is input from the second photosensor 57, the number of coins stored in the coin storing cylinder 30A, 30B, 30C, 30D, 30E, 30F provided with the second photosensor 57 which output the coin excess signal exceeds the second predetermined number and it is impossible to store any further coins in the coin storing cylinder 30A, 30B, 30C, 30D, 30E or 30F. Therefore, the microcomputer 50 does not output a drive signal to the sorting device **31*a*, 31*b*, 31*c*, 31*d*, 31*e*, 31*f* associated with the coin storing cylinder 30A, 30B, 30C, 30D, 30E, 30F and the coin passes through the coin passage 25 and is fed to the temporary storing portion 4. Further, the coin is fed to the replenishment coin storing box 15 via the rotatable disk 5, the coin passage 8, the sorting passage 12 and the second passage 16** and accommodated therein.

After the second photosensor 57 of one of the coin storing cylinders 30A, 30B, 30C, 30D, 30E, 30F outputs a coin excess signal, the microcomputer 50 adds the number of coins passing through the sensor 10 to the number of coins of the denomination stored in the memory 67 and stores the result in the memory 67.

When a customer operates the dispensation button 53 for dispensation and requests an amount of coins to be dispensed, the microcomputer 50 calculates the number of coins of each denomination to be dispensed so that the number of coins dispensed becomes minimum and outputs drive signals to the feed-out mechanism driving means 66A, 66B, 66C, 66D, 66E, 66F of the coin storing cylinders 30A, 30B, 30C, 30D, 30E, 30F storing coins to be dispensed. In this embodiment, the drive signals are simultaneously output to the feed-out mechanism driving means 66A, 66B, 66C, 66D, 66E, 66F and coins are simultaneously dispensed from the coin storing cylinder 30A, 30B, 30C, 30D, 30E, 30F. The feed-out mechanism driving means 66A, 66B, 66C, 66D, 66E, 66F which has received a drive signal feeds out coins in the number determined in accordance with the drive signal onto the transporting belt 21. Coins fed out onto the transporting belt 21 are fed onto the rotatable disk 22 and are further fed to the sensor 27. After the sensor 27 has discriminated whether or not the coins are genuine, foreign coins or damaged coins the damage level of which exceeds the predetermined level, and the denomination of the coins, and has counted the coins of each denomination, the coins are fed to the sorting device 28. Since coins stored in the coin storing cylinder 30A, 30B, 30C, 30D, 30E, 30F have been discriminated to be acceptable by the sensor 10 and the sensor 27, only when the denomination of the coin is different from that to be stored in the coin storing cylinder 30A, 30B, 30C, 30D, 30E, 30F from which the coin was fed out, the microcomputer 50 outputs drive signals to the sorting device 28 and the gates G1 and G3, thereby collecting the coin in the coin collecting box 43 via the sorting passage 29 and the bifurcating passages 35, 39. Since no drive signal is output from the microcomputer 50 to the sorting devices 31*a*, 31*b*, 31*c*, 31*d*, 31*e*, 31*f*, other coins pass over the sorting devices 31*a*, 31*b*, 31*c*, 31*d*, 31*e*, 31*f* and are fed to the temporary storing portion 4, whereby they are taken out by the customer through the transaction opening 2.

When the first photosensor 56 of one of the coin storing cylinders 30A, 30B, 30C, 30D, 30E, 30F detects that the number of coins stored in the corresponding coin storing cylinder 30A, 30B, 30C, 30D, 30E, 30F has become lower than a first predetermined number and outputs a coin shortage signal to the microcomputer 50 during the dispensing operation, the microcomputer 50 starts to supply coins from the replenishment coin storing box 15 to the coin storing cylinder 30A, 30B, 30C, 30D, 30E, 30F provided with the first sensor 56 which outputs the coin shortage signal.

More specifically, the microcomputer 50 outputs drive signals to the drive means 63 for rotating the rotatable disk 19 and the drive means 69 for opening or closing the gate 20, thereby rotating the rotatable disk 19 and opening the gate 20 so as to feed coins stored in the replenishment coin storing box 15 onto the transporting belt 21 via the gate 20. Coins fed onto the transporting belt 21 are fed onto the rotatable disk 22 and are further fed from the rotatable disk 22 to the coin passage 25 through the slot 24. After the sensor 27 has discriminated whether or not the coins are genuine, foreign coins or damaged coins the damage level of which exceeds the predetermined level, namely, whether or not coins are acceptable, and the denomination of the coins, and has counted the coins of each denomination, the coins are fed to the sorting device 28. Since coins stored in the replenishment coin storing box 15 have been discriminated to be acceptable by the sensor 10 and the sensor 27, no drive signal is output to the sorting device 28 and, therefore, coins pass over the sorting device 28 and are further fed downstream in the coin passage 25. Similarly to the operation for receiving coins from the temporary storing box 13, the microcomputer 50 feeds coins into the coin storing cylinders 30A, 30B, 30C, 30D, 30E, 30F or the coin replenishing box 15, depending upon the discriminating signals and the counting signals from the sensor 27 and whether or not the coin excess signal has been input from the second sensor 57.

The microcomputer 50 calculates the number of coins of each denomination stored in the replenishment coin storing box 15 based upon the discriminating signals and the count signals from the sensor 27 and the sensor 10 when it receives a coin excess signal from one of the second photosensors 57, while the microcomputer 50 calculates the number of coins of each denomination stored in the replenishment coin storing box 15 based upon the discriminating signals and the count signals from the sensor 27 when it does not receive a coin excess signal from any second photosensor 57, and the microcomputer 50 stores the thus calculated number in the memory 67.

Thus, when supply of replenishment coins from the replenishment coin storing box 15 has started, the microcomputer 50 determines whether or not it is receiving from a discrimination means 68 a judgment signal showing the fact that the number of coins of any denomination stored in the replenishment coin storing box 15 has become lower than a third predetermined number while the coins are being supplied. In this embodiment, since the number of coins accommodated in the replenishment coin storing box 15 is stored in the memory 67 in accordance with their denominations, the discrimination means 68 discriminates whether the number of coins of each denomination stored in the memory 67 is lower than the third predetermined number and outputs the judgment signal to the microcomputer 50 when the number of coins of any denomination is lower than the third predetermined number. When the microcomputer 50 receives the judgment signal from the discrimination means 68, it outputs to an notification means 71 a notification signal for announcing to the teller the denomination of coins whose number has become lower than the third predetermined number and which have to be supplied for replenishing the coins in the coin replenishing box 40, thereby causing the notification means 71 to display such information.

The coin receiving and dispensing machine 1 according to this embodiment is constituted so that when the notification signal is output from the microcomputer 50 to the notification means 71 and the information is displayed the teller can remove the coin replenishing box 40 to replenish the coins therein and then remount the coin replenishing box 40 on the coin receiving and dispensing machine 1, and therefore, the third predetermined number is determined so that even if coins are supplied from the coin replenishing box 40 to the coin storing cylinders 30A, 30B, 30C, 30D, 30E, 30F during the period when the teller removes the coin replenishing box 40 to supply coins thereinto and remounts it on the coin receiving and dispensing machine 1, there is no risk of coins of any denomination running short in the coin replenishing box 40.

When the teller has removed the coin replenishing box 40, filled it with coins and remounted it on the coin receiving and dispensing machine 1, if one of the first photosensors 56 associated with the coin storing cylinders 30A, 30B, 30C, 30D, 30E, 30F has detected that the number of coins stored in the associated coin storing cylinder 30A, 30B, 30C, 30D, 30E, 30F and has output a coin shortage signal to the microcomputer 50 and the discrimination means 68 has output to the microcomputer 50 a judgment signal indicating that the number of coins stored in the replenishment coin box 15 of the denomination which the coin shortage signal was output for has become lower than a third predetermined number, the microcomputer 50 starts to supply coins from the coin replenishing box 40 to the coin storing cylinder 30A, 30B, 30C, 30D, 30E, 30F and the replenishment coin box 15.

More specifically, the microcomputer 50 outputs drive signals to the drive means 65 for rotating the rotatable disk 44 and the drive means 70 for driving the gate 45, thereby rotating the rotatable disk 44 and opening the gate 45 to feed out coins stored in the coin replenishing box 40 onto the transporting belt 46 via the gate 45 to further feed them onto the transporting belt 21. Coins having been fed onto the transporting belt 21 are fed onto the rotatable disk 22 and are further fed from the rotatable disk 22 to the coin passage 25 through the slot 24. The sensor 27 discriminates whether or not the coins fed to the coin passage 25 are genuine, whether or not they are foreign coins and whether or not they are damaged coins the damage level of which exceeds a predetermined level, namely, whether or not they are acceptable, and the denominations thereof and counts the number of coins of each denomination. Then, the coins are fed to the sorting device 28. If the teller has erroneously supplied the coin replenishing box 40 with a counterfeit coin, foreign coin or damaged coin, namely, an unacceptable coin, the sensor 27 detects the unacceptable coin and sends a discriminating signal to the microcomputer 50 so that the microcomputer 50 outputs a drive signal to the sorting device 28, thereby driving the sorting device 28 so that the unacceptable coin is led into the sorting passage 29 and is collected in the unacceptable coin collecting box 42 via the bifurcating passages 35, 38. On the contrary, when the sensor detects an acceptable coin, the microcomputer 50 outputs no drive signal to the sorting device 28 in accordance with a discriminating signal from the sensor 27 and, as a result, the acceptable coin is fed to the coin passage 25. If the microcomputer 50 does not receive a coin excess signal from any of the second photosensors 57, when each of the sensors 55*a*, 55*b*, 55*c*, 55*d*, 55*e*, 55*f* associated with the coin storing cylinder 30A, 30B, 30C, 30D, 30E, 30F detects coins the denomination of which is the same as that to be stored in the corresponding coin storing cylinder 30A, 30B, 30C, 30D, 30E, 30F, the microcomputer 50 outputs a drive signal to each of the sorting devices 31*a*, 31*b*, 31*c*, 31*d*, 31*e*, 31*f* associated with the coin storing cylinder 30A, 30B, 30C, 30D, 30E, 30F in accordance with the denominations of coins discriminated by the sensor 27, thereby causing the corresponding coin storing cylinder 30A, 30B, 30C, 30D, 30E, 30F to accommodate them. On the other hand, if a coin excess signal is input to the microcomputer 50, since the number of coins stored in the coin storing cylinder 30A, 30B, 30C, 30D, 30E, 30F provided with the second photosensor 57 which output the coin excess signal exceeds the second predetermined number and no more coins can be accommodated therein, the microcomputer 50 does not output a drive signal to the sorting device 31*a*, 31*b*, 31*c*, 31*d*, 31*e*, 31*f* associated with the coin storing cylinder 30A, 30B, 30C, 30D, 30E, 30F, whereby the coin is fed to the temporary storing portion 4 through the coin passage 25 and is further fed to and accommodated in the replenishment coin storing box 15 via the rotatable disk 5, the coin passage 8, the sorting passage 12 and the second passage 16.

The microcomputer 50 calculates the number of coins stored in the replenishment coin storing box 15 in accordance with their denominations based upon the discriminating signals and the count signals from the sensor 27 and the sensor 10 when a coin excess signal is input from any of the second photosensors 57 or the discriminating signals and the count signals from the sensor 27 when no coin excess signal is input from any of the second photosensors 57 and stores the calculated number in the memory 67.

When a predetermined number of coins has been accommodated in the coin storing cylinder 30A, 30B, 30C, 30D, 30E, 30F to which coins are to be replenished in this manner the microcomputer 50 outputs drive stop signals to the drive means 65 and the drive means 70, thereby stopping the rotation of the rotatable disk 44 and closing the gate 45 so that the operation for feeding out coins from the coin replenishing box 40 is terminated. Then all coins fed out from the coin replenishing box 40 are supplied to the coin storing cylinder 30A, 30B, 30C, 30D, 30E, 30F or the replenishment coin storing box 15 by further driving the transporting belt mechanism 21 and the rotatable disk 22 for a predetermined time period, whereby the coin replenishing operation is completed.

Even if a predetermined time period has passed after a customer requested coin dispensation and coins were dispensed into the temporary storing portion 4 from the coin storing cylinders 30A, 30B, 30C, 30D, 30E, 30F, if all or a part of coins dispensed remain in the temporary storing portion 4, the microcomputer 50 judges that the customer failed to collect all or a part of the coins dispensed from the coin storing cylinders 30A, 30B, 30C, 30D, 30E, 30F and causes the coins to be dropped onto the rotatable disk 5. Then, the coins are fed to the coin passage 8 and are dropped onto the transporting belt 21 from the coin dropping passage 17, whereby the coins are fed onto the rotatable disk 22. Then, the microcomputer 50 outputs drive signals to the sorting device 28 and the gates G1, G2, thereby collecting the coins in the uncollected coin collecting box 41.

According to this embodiment, when one of the first photosensor 56 provided for the coin storing cylinders 30A, 30B, 30C, 30D, 30E, 30F detects that the number of coins stored in the coin storing cylinder 30A, 30B, 30C, 30D, 30E, 30F has become lower than the first predetermined number a coin shortage signal is output to the microcomputer 50 and coins are supplied from the replenishment coin storing box 15 to the coin storing cylinder 30A, 30B, 30C, 30D, 30E, 30F. If the number of coins of one of the denominations stored in the replenishment coin storing box 15 has become lower than the third predetermined number and it is considered difficult to supply coins of the denomination from the replenishment coin storing box 15, a judgment signal is output from the discrimination means 68 to the microcomputer 50 in accordance with the number of coins of each denomination stored in the replenishment coin storing box 15 which is stored in the memory 67, and when the judgment signal is input from the discrimination means 68, the microcomputer 50 outputs a notification signal to the notification means 71, thereby to inform the teller that the number of coins of one of the denominations stored in the replenishment coin storing box 15 has become lower than the third predetermined number. As a result, the teller can remove the removable coin replenishing box 40 and supply coins thereto. Further, the third predetermined number is determined so that even if coins are supplied from the coin replenishing box 40 to the coin storing cylinder 30A, 30B, 30C, 30D, 30E, 30F during a period when the teller removes the removable coin replenishing box 40 to supply coins thereto and remounts it on the coin receiving and dispensing machine 1 and even if the number of coins of any denomination stored in the replenishment coin storing box 15 runs short, there is no risk of coins of any denomination running short in the coin replenishing box 40 while coins are being supplied to the coin storing cylinders 30A, 30B, 30C, 30D, 30E, 30F in which the number of coins has become short, so that it is possible to remove the coin replenishing box 40 and supply coins thereto without stopping the supply of coins from the replenishment coin storing box 15 to the coin storing cylinder 30A, 30B, 30C, 30D, 30E, 30F. Therefore, even if the number of coins stored in one of the coin storing cylinders 30A, 30B, 30C, 30D, 30E, 30F has become lower than the first predetermined number, since coins are immediately supplied thereto it is possible to supply coins without stopping the coin dispensing operation of the coin receiving and dispensing machine 1. Further, in the case where coins are deposited by a customer and the number of coins stored in one of the coin storing cylinders 30A, 30B, 30C, 30D, 30E, 30F exceeds the second predetermined number while the coin replenishing box 40 is removed from the coin receiving and dispensing machine 1 and coins are being supplied thereto, since it is possible to store coins to be stored in the coin storing cylinder 30A, 30B, 30C, 30D, 30E, 30F in the replenishment coin storing box 15, the coin receiving operation can be effected even while the coin replenishing box 40 is removed from the coin receiving and dispensing machine 1 and coins are being supplied thereto, it is possible to markedly improve the operation efficiency of the coin receiving and dispensing machine 1.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, in the case where the denomination of a coin fed out from a coin storing cylinder 30A, 30B, 30C, 30D, 30E, 30F is different from that to be stored in the coin storing cylinder 30A, 30B, 30C, 30D, 30E, 30F, the coin is collected in the coin collecting box 43, but, instead, the coin may be accommodated in the coin storing cylinder 30A, 30B, 30C, 30D, 30E, 30F in which it is to be stored.

Further, each of the sensors 10, 27 in the above described embodiment, need not be constituted as a single sensor physically and may instead be constituted ass for example, an optical sensor and a magnetic sensor.

Furthermore, in the above described embodiment, when one of the first photosensors 56 of the coin storing cylinders 30A, 30B, 30C, 30D, 30E, 30F detects that the number of coins stored in the corresponding coin storing cylinder 30A, 30B, 30C, 30D, 30E, 30F has become lower than the first predetermined number and a coin shortage signal is input to the microcomputer 50 so that coins are supplied from the replenishment coin storing box 15 or the coin replenishing box 40 so long as no coin excess signal is input from any second photosensor 57, coins are accommodated in the corresponding coin storing cylinders 30A, 30B, 30C, 30D, 30E, 30F in accordance with the denominations of coins discriminated by the sensor 27, but it is possible instead for coins having other denominations than that to be accommodated in the coin storing cylinder 30A, 30B, 30C, 30D, 30E, 30F to which coins are to be supplied to be fed to the temporary storing portion 4 and further fed to and accommodated in the replenishment coin storing box 15 via the rotatable disk 5, the coin passage 8, the sorting passage 12 and the second passage 16.

Moreover, in the above described embodiment, when the coin replenishing box 40 has been removed to supply coins thereto and is remounted on the coin receiving and dispensing machine 1, if the microcomputer 50 receives a coin shortage signal from one of the first sensors 56 of the coin storing cylinders 30A, 30B, 30C, 30D, 30E, 30F and a judgment signal from the discrimination means 68, coins are supplied from the coin replenishing box 40 to one of the coin storing cylinders 30A, 30B, 30C, 30D, 30E, 30F or the replenishment coin storing box 15, but instead, when the coin replenishing box 40 has been removed to supply coins thereinto and is remounted on the coin receiving and dispensing machine 1, coins can, similarly to at the start of operation, be immediately supplied from the coin replenishing box 40 to one of the coin storing cylinders 30A, 30B, 30C, 30D, 30E, 30F or the replenishment coin storing box 15 irrespective of whether or not the coin shortage signal or the judgment signal is input to the microcomputer 50.

Further, in the above described embodiments when the number of coins of any denomination stored in the replenishment coin storing box 15 has become lower than the third predetermined number and the judgment signal is input from the discrimination means 68 to the microcomputer 50, it can be expected that a notification signal will be output to the notification means 71 and in accordance with this notification signal, the teller will immediately remove the coin replenishing box 40 from the coin receiving and dispensing machine 1, supply coins thereto and remount it on the coin receiving and dispensing machine 1, but instead, when the number of coins having other denominations than that to be stored in the coin storing cylinder 30A, 30B, 30C, 30D, 30E, 30F provided with the first photosensor 56 which output a coin shortage signal has become lower than the third predetermined number, since it is possible to supply coins to the coin storing cylinder 30A, 30B, 30C, 30D, 30E, 30F provided with the first photosensor 56 which output a coin shortage signal by using coins stored in the replenishment coin storing box 15 without removing the coin replenishing box 40 for supplying coins thereinto, it is possible to output an ordinary notification signal to the notification means 71 at this time and output an emergency notification signal thereto when supplying coins from the replenishment coin storing box 15 has been completed, thereby causing the teller to remove the coin replenishing box 40 from the coin receiving and dispensing machine 1 and to supply coins thereto and an emergency notification signal may be immediately output to the notification means 71 only when the number of coins stored in the replenishment coin storing box 15, the denomination of which is the same as that to be accommodated in the coin storing cylinder 30A, 30B, 30C, 30D, 30E, 30F provided with the first photosensor 56 which output a coin shortage signal, has become lower than the third predetermined number.

INDUSTRIAL APPLICABILITY

As described above, the coin receiving and dispensing machine according to the present invention is useful as a coin receiving and dispensing machine capable of receiving and dispensing coins during replenishment of the coins therein.

I claim:

1. A coin receiving and dispensing machine comprising:

a transaction opening through which coins are deposited;

first sensor means provided in a coin passage for discriminating whether or not coins deposited through the transaction opening are acceptable, for determining denominations of coins and for determining a number of received coins in accordance with their denominations;

coin sorting means for sorting acceptable coins in accordance with their denominations;

a plurality of coin storing means each for accommodating and storing coins sorted by the coin sorting means in accordance with their denominations;

second sensor means provided one for each coin storing means for detecting whether or not the number of coins stored in the associated coin storing means is lower than a first predetermined number;

third sensor means provided one for each coin storing means for detecting whether or not the number of coins stored in the associated coin storing means exceeds a second predetermined number greater than the first predetermined number;

replenishment coin storing means for storing coins for replenishing the coins stored in the coin storing means when the associated second sensor means detects that the number of coins stored in the coin storing means has become lower than the first predetermined number and for storing coins when the associated third sensor means detects that the number of coins stored in the coin storing means has exceeded the second predetermined number; and discrimination means for storing information regarding a number of coins stored in the replenishment coin storing means in accordance with their denominations, for discriminating whether or not the number of coins of each denomination stored in the replenishment coin storing means has become lower than a third predetermined number and outputting a judgment signal when the number of coins of one of the denominations has become lower than the third predetermined number;

notification means for, when the number of coins of one of the denominations has become lower than the third predetermined number and the discrimination means outputs a judgment signal, receiving a notification signal to such effect;

coin replenishing means removable from the machine and adapted for storing coins for replenishing the coins in the coin storing means and the replenishment coin storing means when the notification signal is output to the notification means;

fourth sensor means for discriminating the denominations of coins fed out from the coin replenishing means and the replenishment coin storing means and for counting the number of coins in accordance with their denominations; and transporting means for transporting coins fed out from the replenishment coin storing means and the coin replenishing means to the coin sorting means;

the coin sorting means for sorting coins fed out from the replenishment coin storing means and the coin replenishing means and for replenishing coins in the coin storing means in accordance with their denominations.

2. A coin receiving and dispensing machine in accordance with claim 1, further comprising:

temporary storing means adjacent to the transaction opening for temporarily storing coins;

a first rotatable disk for receiving coins from the temporary storing means and for feeding coins one by one to the coin passage by a centrifugal force produced by rotation;

a second rotatable disk provided for the replenishment coin storing means; and a third rotatable disk provided for the coin replenishing means;

the transporting means comprising:

first transporting means connected to the second rotatable disk at one end and connected to a fourth rotatable disk at another end, and second transporting means connected to the third rotatable disk and arranged to deliver coins to the first transporting means;

a coin sorting passage connected to the fourth rotatable disk for feeding coins to the coin storing means and the temporary storing means;

the third rotatable disk for feeding out coins stored in the coin replenishing means to the second transporting means by centrifugal force produced by rotation;

the second rotatable disk for feeding out coins stored in the replenishment coin storing means to the first transporting means by centrifugal force produced by rotation; and the fourth rotatable disk for feeding out coins one by one to the coin sorting means by centrifugal force produced by rotation.

3. A coin receiving and dispensing machine in accordance with claim 1, further comprising:

a temporary storing box for temporarily storing acceptable coins;

first sorting means provided on the coin passage and connected to the temporary storing box for sorting acceptable coins, the first sorting means having at a bottom thereof a shutter which can be opened and closed; and gate means provided between the first sorting means and the temporary storing box for guiding acceptable coins into the temporary storing box and, when one of the third sensor means detects that the number of coins stored in the associated coin storing means has exceeded the second predetermined number, for guiding coins fed out from the temporary storing box.

4. A coin receiving and dispensing machine in accordance with claim 2, further comprising:

a temporary storing box for temporarily storing acceptable coins;

first sorting means provided on the coin passage and connected to the temporary storing box for sorting acceptable coins, the first sorting means having at a bottom thereof a shutter which can be opened and closed; and gate means provided between the first sorting means and the temporary storing box for guiding acceptable coins into the temporary storing box and, when one of the third sensor means detects that the number of coins stored in the associated coin storing means has exceeded the second predetermined number, for guiding coins fed out from the temporary storing box.

* * * * *